US006604874B2

(12) United States Patent
Carriere et al.

(10) Patent No.: US 6,604,874 B2
(45) Date of Patent: Aug. 12, 2003

(54) PRINTER WITH MULTIFUNCTIONAL LEVER ACTUATED MECHANISM

(75) Inventors: Richard L. Carriere, Oak Creek, WI (US); Kevin L. Wilken, De Pere, WI (US); Jeffery J. Brickl, Lodi, WI (US); Edward A. Raleigh, Waunakee, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 30 days.

(21) Appl. No.: 10/002,520

(22) Filed: Nov. 1, 2001

(65) Prior Publication Data

US 2003/0081977 A1 May 1, 2003

(51) Int. Cl.[7] ..... B41J 3/36; B41J 15/04; B41J 29/02; B41J 29/56

(52) U.S. Cl. ..... 400/88; 400/621; 400/613; 400/648; 400/649; 400/693; 400/663

(58) Field of Search ..... 400/648, 649, 400/663, 664, 88, 613, 615.2, 621, 693

(56) References Cited

U.S. PATENT DOCUMENTS

| | | | | |
|---|---|---|---|---|
| 4,264,396 A | | 4/1981 | Stewart | |
| 4,407,692 A | | 10/1983 | Torbeck | |
| 4,440,248 A | | 4/1984 | Teraoka | |
| 4,473,426 A | | 9/1984 | Goodwin et al. | |
| 4,477,305 A | | 10/1984 | Hamisch, Jr. et al. | |
| 4,490,206 A | | 12/1984 | Makley | |
| 4,497,682 A | | 2/1985 | Hamisch, Jr. | |
| 4,498,947 A | | 2/1985 | Hamisch, Jr. et al. | |
| 4,501,224 A | | 2/1985 | Shibayama et al. | |
| 4,511,422 A | | 4/1985 | Hamisch, Jr. et al. | |
| 4,544,434 A | | 10/1985 | Mistyurik | |
| 4,556,442 A | | 12/1985 | Torbeck | |
| 4,630,538 A | | 12/1986 | Cushman | |
| 4,655,129 A | | 4/1987 | Wirth et al. | |
| 4,680,078 A | | 7/1987 | Vanderpool et al. | |
| 4,815,871 A | * | 3/1989 | McGourty et al. | 400/120.16 |
| 4,848,941 A | * | 7/1989 | Imaseki | 406/120 |
| 5,051,009 A | | 9/1991 | Sugiura et al. | |
| 5,056,940 A | | 10/1991 | Basile | |

(List continued on next page.)

FOREIGN PATENT DOCUMENTS

| | | | | |
|---|---|---|---|---|
| EP | 0 661 163 A3 | | 9/1996 | |
| JP | 02160558 A | * | 6/1990 | B41J/2/32 |
| JP | 04193566 A | * | 7/1992 | B41J/17/02 |
| JP | 05104840 A | * | 4/1993 | B41J/32/00 |

OTHER PUBLICATIONS

US 4,561,048, 12/1985, Takamura et al. (withdrawn)

*Primary Examiner*—Daniel J. Colilla
(74) *Attorney, Agent, or Firm*—Quarles & Brady LLP

(57) ABSTRACT

A printer mechanism having a receptacle for receiving a printer cartridge therein. A print head is disposed in the receptacle, and a platen roller is rotatable about a roller axis. The platen roller is movable between a printing position in close proximity to the print head for urging labeling media and ink ribbon toward the print head and a nonprinting position in which the roller platen is spaced a distance from said print head to allow the labeling media and ink ribbon to be slipped therebetween. A platen roller gear is coaxial with said platen roller, and is engaged with a drive gear when the platen roller is in the printing position and disengaged from the platen roller gear when the platen roller is in the nonprinting position. A lever is linked to the platen roller, and is movable between a lock position and an unlock position. Movement of the lever from the unlock position to the lock position moves the platen roller from the nonprinting position to the printing position and extends the lever over the receptacle to lock a printer cartridge received therein.

15 Claims, 9 Drawing Sheets

U.S. PATENT DOCUMENTS 5,078,523 A 1/1992 McGourty et al.
5,120,147 A * 6/1992 Ozaki ..... 400/649
5,139,351 A * 8/1992 Kamada ..... 400/120.16
5,165,806 A 11/1992 Collins
5,211,491 A 5/1993 Harvey
5,411,339 A 5/1995 Bahrabadi et al.
5,435,657 A 7/1995 Pearce et al.
5,533,818 A * 7/1996 Bahrabadi ..... 400/208
6,267,520 B1 * 7/2001 Unno et al. ..... 400/663

* cited by examiner

FIG. 11
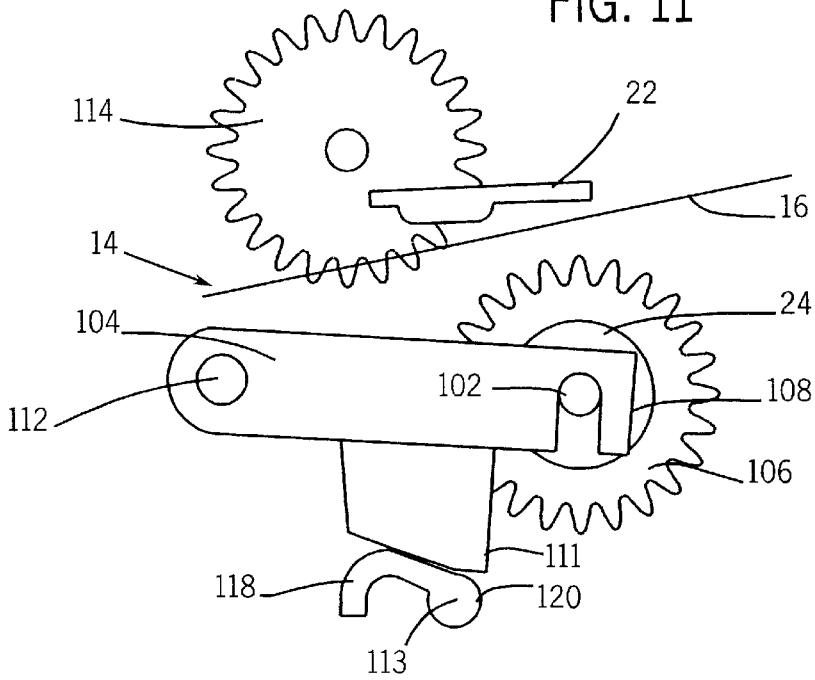
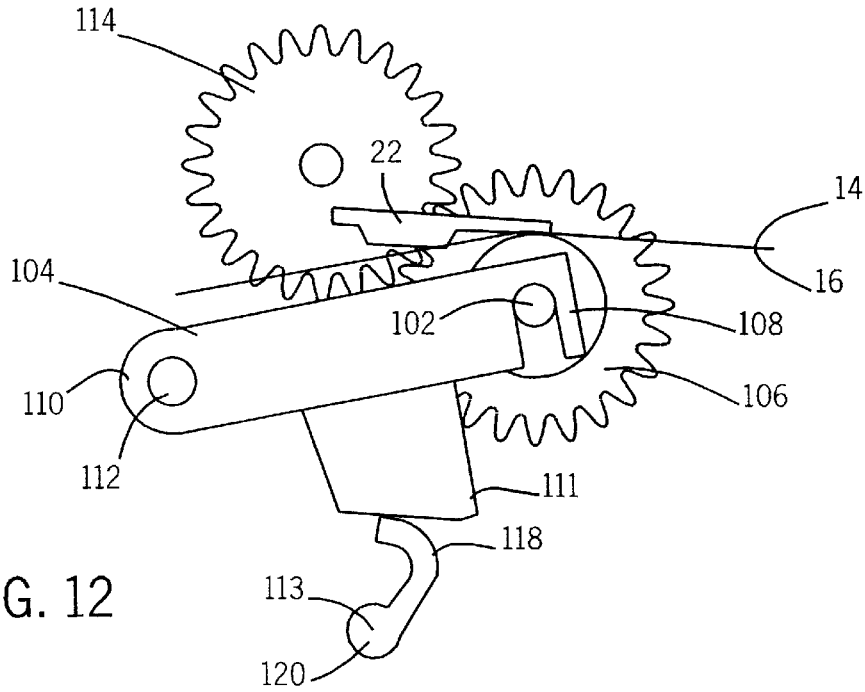
FIG. 12

PRINTER WITH MULTIFUNCTIONAL LEVER ACTUATED MECHANISM

CROSS REFERENCES TO RELATED APPLICATIONS

Not Applicable

Statement Regarding Federally Sponsored Research

Not Applicable

TECHNICAL FIELD

The present invention relates to a thermal transfer printer, and more particularly to a hand held thermal transfer printer having a cavity for receiving a printer cartridge containing labeling media and an ink ribbon.

DESCRIPTION OF THE BACKGROUND ART

There are a number of U.S. patents that disclose electronic apparatus for printing indicia on labels, some of these are restricted to hand held units and others that disclose tabletop units. Hand held labeling machines are disclosed, for example, in U.S. Pat. Nos. 4,264,396, Stewart; 4,407,692, Torbeck; 4,473,426, Goodwin et al.; 4,477,305, Hamisch; 4,490,206, Makely; 4,497,683, Hamisch; 4,498,947, Hamisch et al.; 4,511,422, Hamisch et al.; 4,544,434, Mistyurik; 4,556,442, Torbeck; 4,561,048, Hamisch et al.; and 4,680,078, Vanderpool et al. Tabletop units for this general purpose, some of which are portable are described in U.S. Pat. Nos. 4,440,248, Teraoka; 4,501,224, Shibayama; 4,630,538, Cushing; and 4,655,129, With et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, and a visual display such as a LED, LCD unit to assist the operator in using the machine. In a hand held printer, these components may all be enclosed in a single housing.

The labeling media comprises a series of labels that are attached to a carrier strip. The carrier strip is fed through the printer and legends are printed on the labels. The labels are then removed from the carrier and attached to the objects needing identification. As there are many types of label applications, there are many combinations of labels and carrier strips that provide labels of varying sizes, colors and formats.

A particular type of print head employs thermal transfer printing technology. Thermal transfer printing uses a heat generating print head to transfer a pigment, such as wax, carbon black, or the like, from a thermal transfer ribbon to a labeling media. By using digital technology, characters are formed by energizing a sequence of pixels on the print head which in turn melt the wax or other pigment on the ribbon transferring the image to the labeling media.

In a known thermal transfer printer such as a label printer, labeling media is fed by a paper feed roller simultaneously with a platen roller feeding an ink transfer ribbon. While the labeling media driven by the feed roller runs between the print head and the rotating platen roller, the transfer ribbon is passed between the print head and the platen roller by rotating the platen roller. As a result, the labeling media and the transfer ribbon pass together in overlay relationship between the print head and the platen roller.

Loading the above printers with labeling media and an ink ribbon can be difficult and cumbersome. For example, known hand held label printers, such as disclosed in U.S. Pat. No. 5,165,806, include a cartridge containing both labeling media and an ink ribbon. The cartridge is inserted into a cavity formed in the printer body, and interfaces with the printer to print labels. The interface between the cartridge and the printer, however, is complex, and requires more than one step to lock the cartridge into the printer cavity and engage the printer with the cartridge in order to print labels. Accordingly, a need exists for a printer mechanism which provides a simple interface between a printer cartridge and a printer.

SUMMARY OF THE INVENTION

The present invention provides a printer mechanism having a receptacle for receiving a printer cartridge therein. A print head is disposed in the receptacle, and a platen roller is rotatable about a roller axis. The platen roller is movable between a printing position in close proximity to the print head for urging labeling media and ink ribbon toward the print head and a nonprinting position in which the roller platen is spaced a distance from said print head to allow the labeling media and ink ribbon to be slipped therebetween. A platen roller gear is coaxial with said platen roller, and is engaged with a drive gear when the platen roller is in the printing position and disengaged from the platen roller gear when the platen roller is in the nonprinting position. A lever is linked to the platen roller, and is movable between a lock position and an unlock position. Movement of the lever from the unlock position to the lock position moves the platen roller from the nonprinting position to the printing position and extends the lever over the receptacle to lock a printer cartridge received therein.

A general objective of the present invention is to provide a printer mechanism with a simple interface between a printer cartridge and the printer mechanism. This objective is accomplished by providing a printer mechanism and method of use which locks the printer cartridge in a receptacle in the printer, moves a roller platen into a printing position to sandwich labeling media and ink ribbon between the platen roller and a print head, and engages a drive gear with a stationary gear which rotatably drives the drive gear to rotate the platen roller, all in a single action of operating a lever.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 11 is a detailed top view of the printer mechanism assembly of FIG. 3 with the platen roller in the nonprinting position;

FIG. 12 is a detailed top view of the printer mechanism assembly of FIG. 4 with the platen roller in the printing position.

DETAILED DESCRIPTION OF THE PREFERRED EMBODIMENTS

Figure 1:
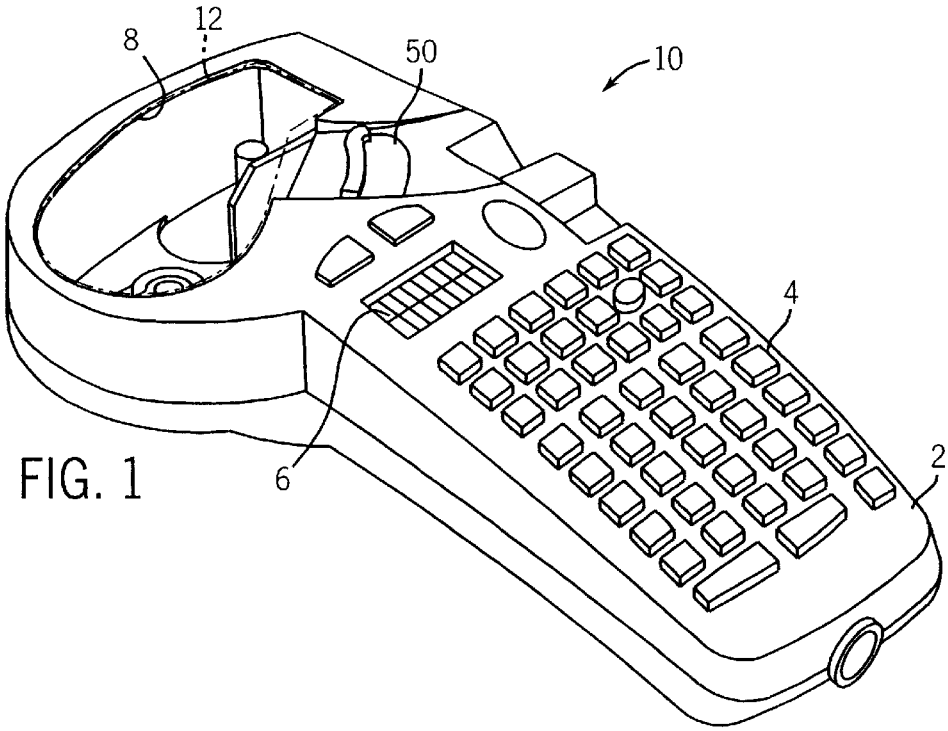
FIG. 1 is a perspective view of a hand held label printer which employs the present invention.
Figure 2:
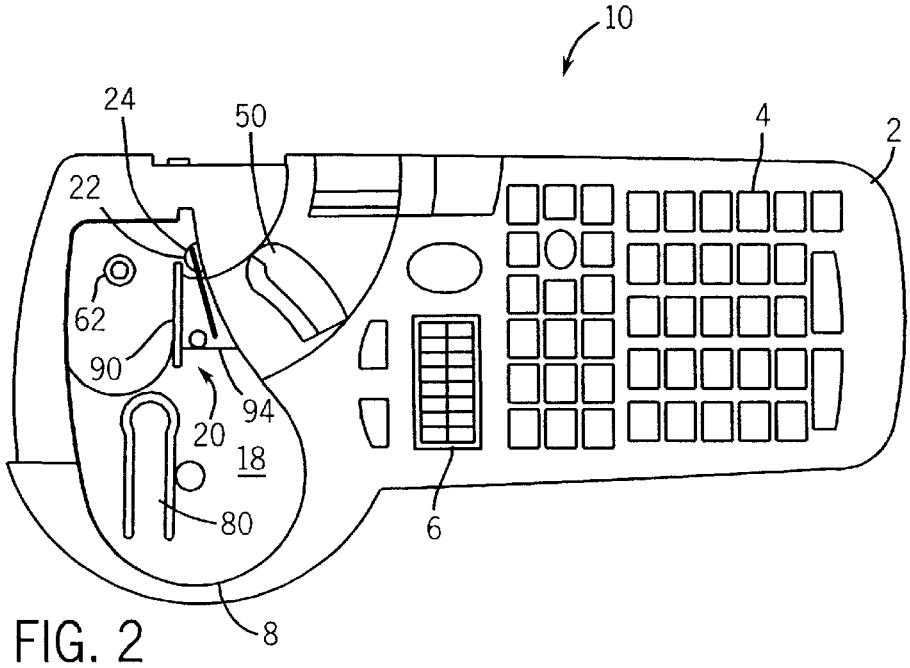
FIG. 2 is a top view of the printer of FIG. 1 with the cartridge removed.
Figure 3:
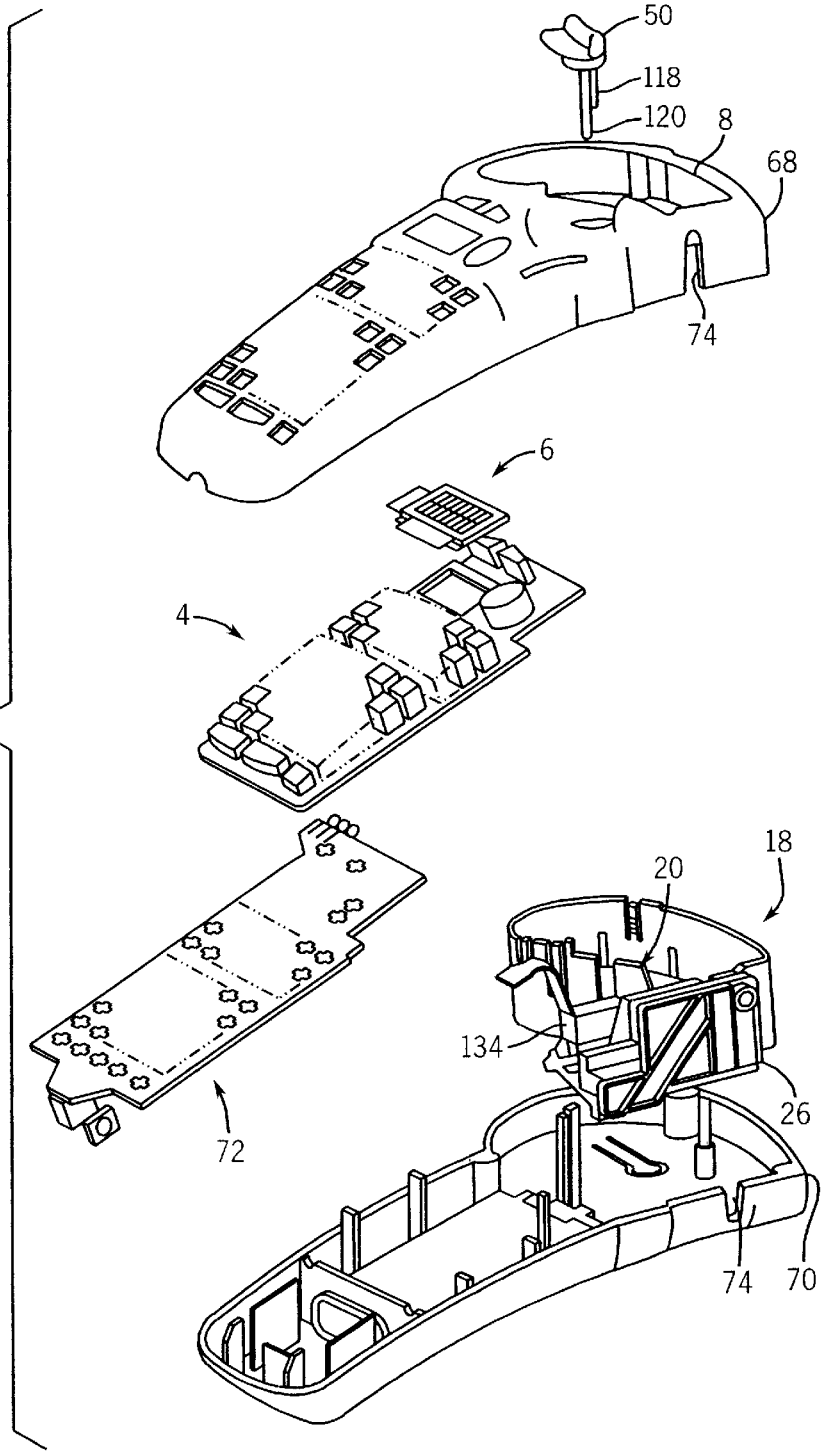
FIG. 3 is an exploded perspective view of the printer of FIG. 2.
Figure 4:
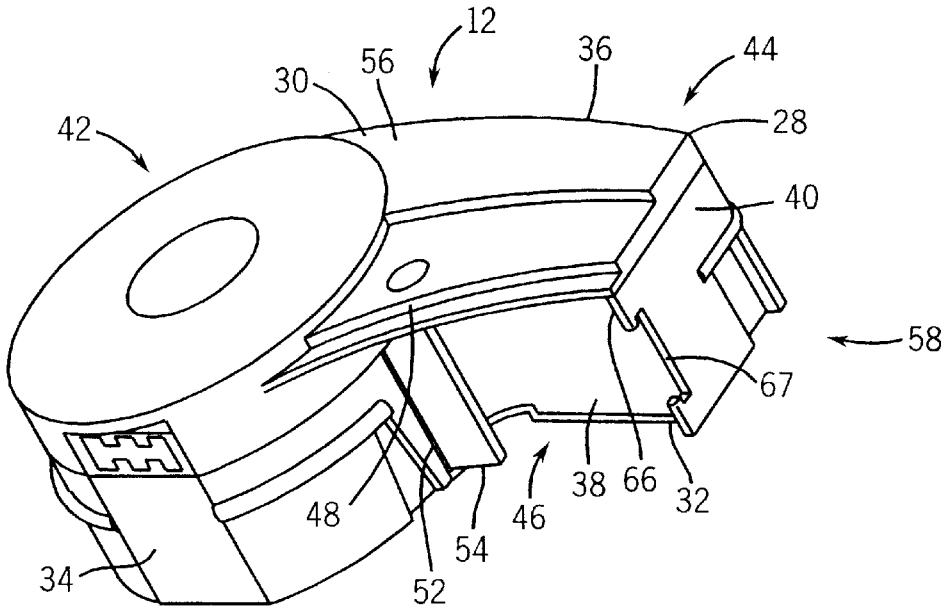
FIG. 4 is a top perspective view of the cartridge of FIG. 1.
Figure 5:
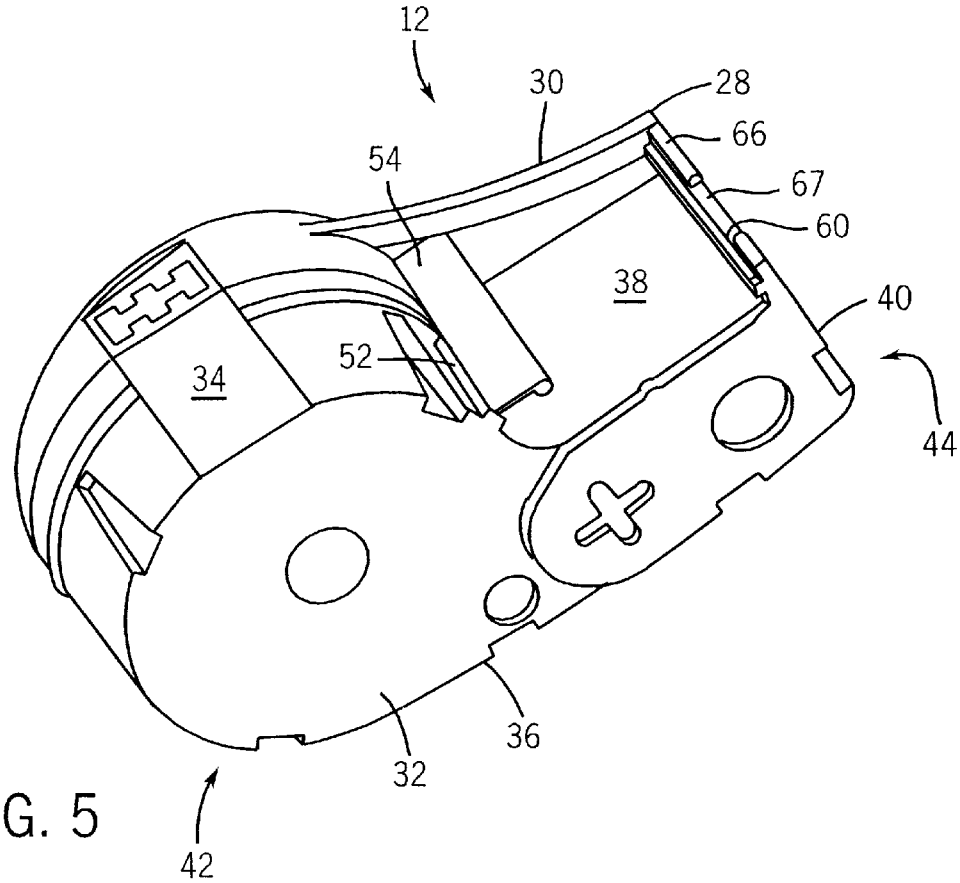
FIG. 5 is a bottom perspective view of the cartridge of FIG. 1.
Figure 6:
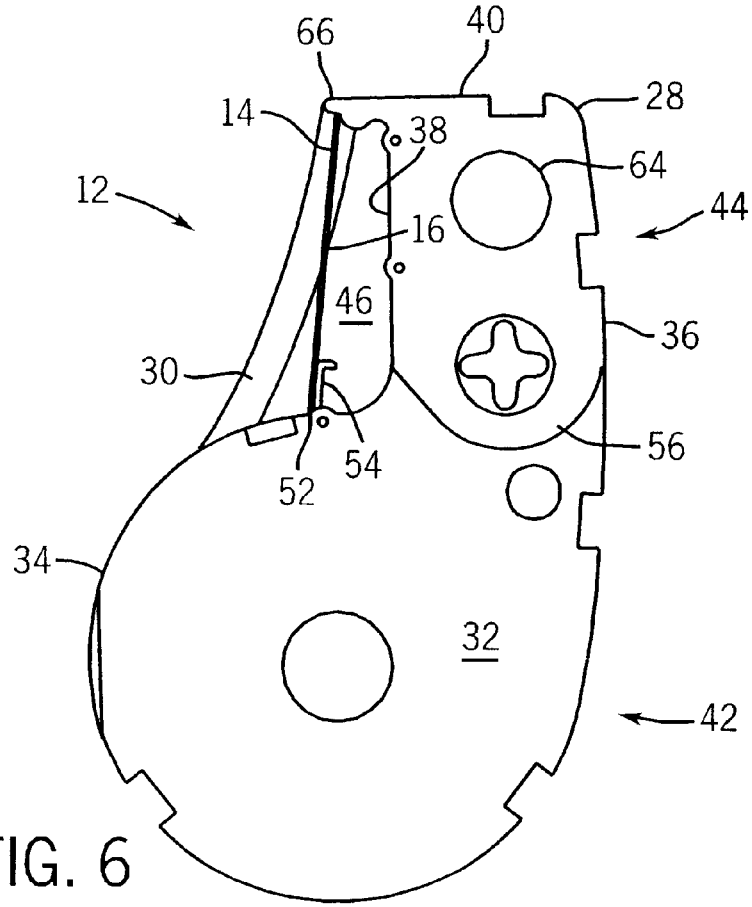
FIG. 6 is a bottom view of the cartridge of FIG. 1.
Figure 9:
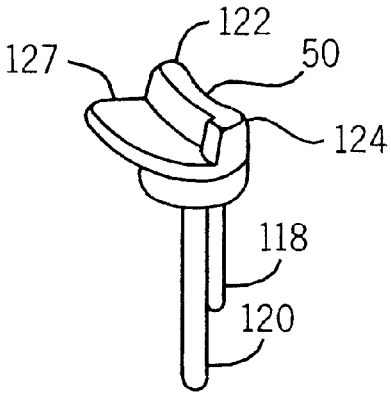
FIG. 9 is a perspective view of the camshaft, cam and lever of FIG. 3.
Figure 7:
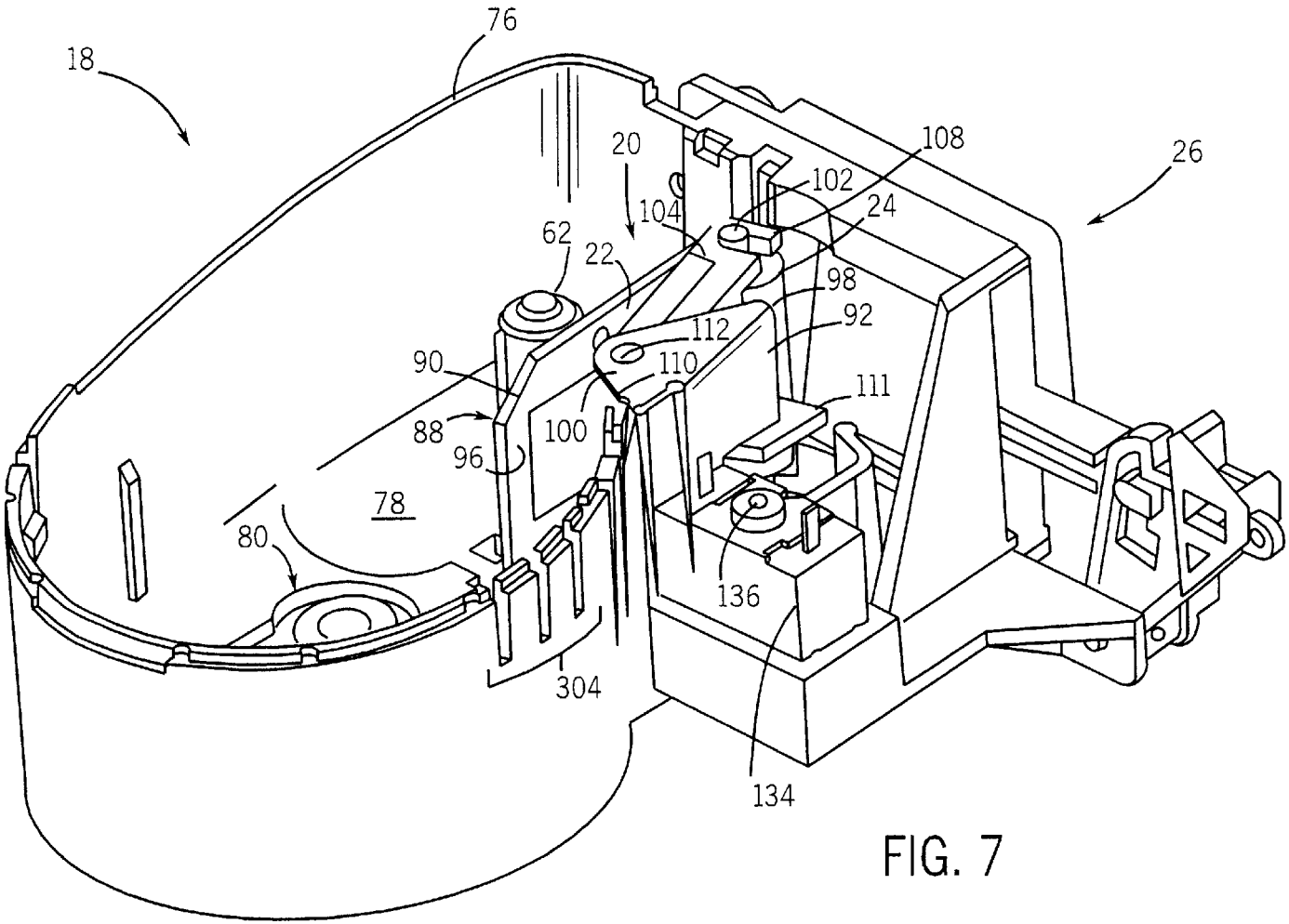
FIG. 7 is a top perspective view of the cartridge receptacle of the printer of FIG. 2.
Figure 8:
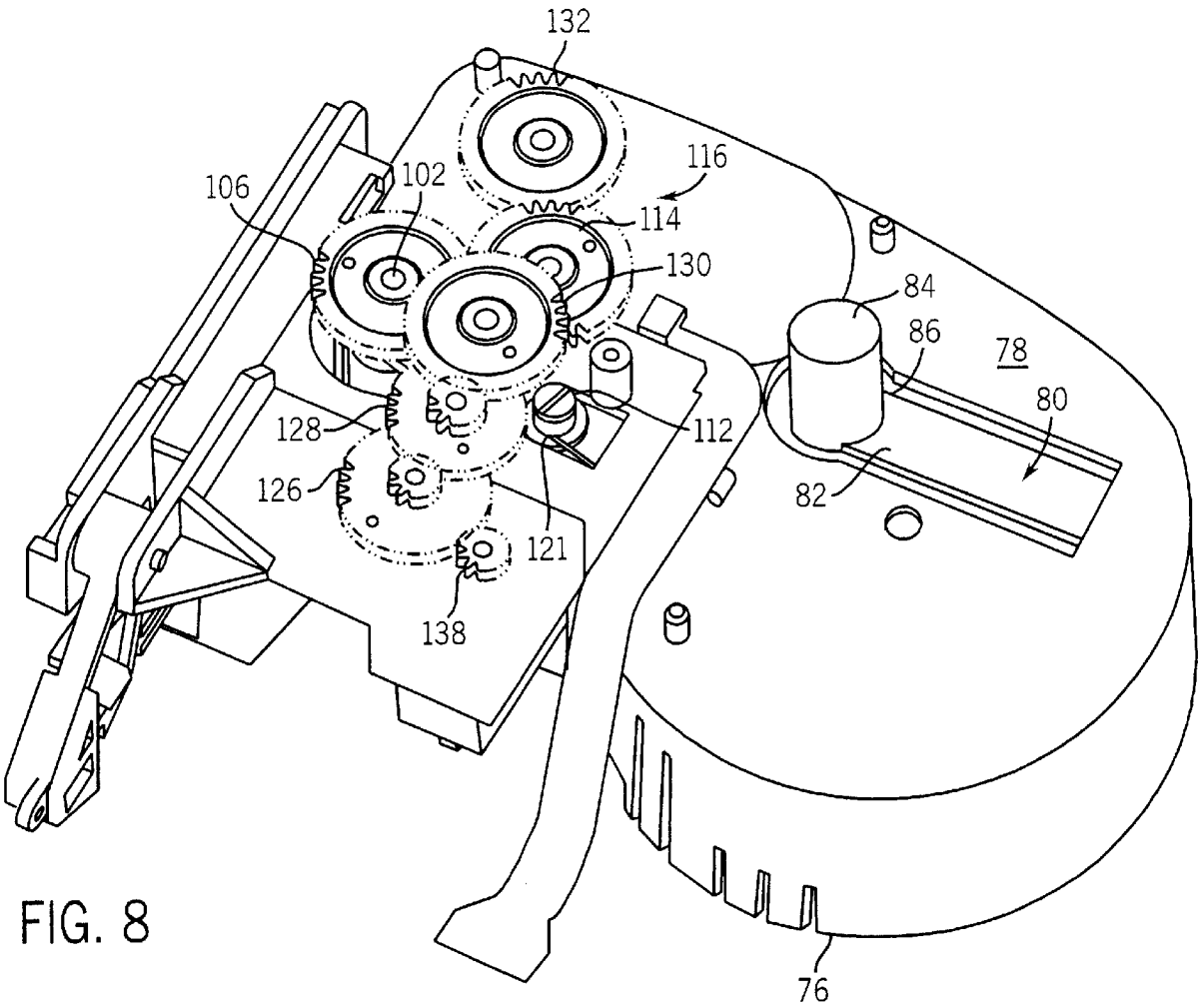
FIG. 8 is a bottom perspective view of the cartridge receptacle of FIG. 7.
Figure 10:
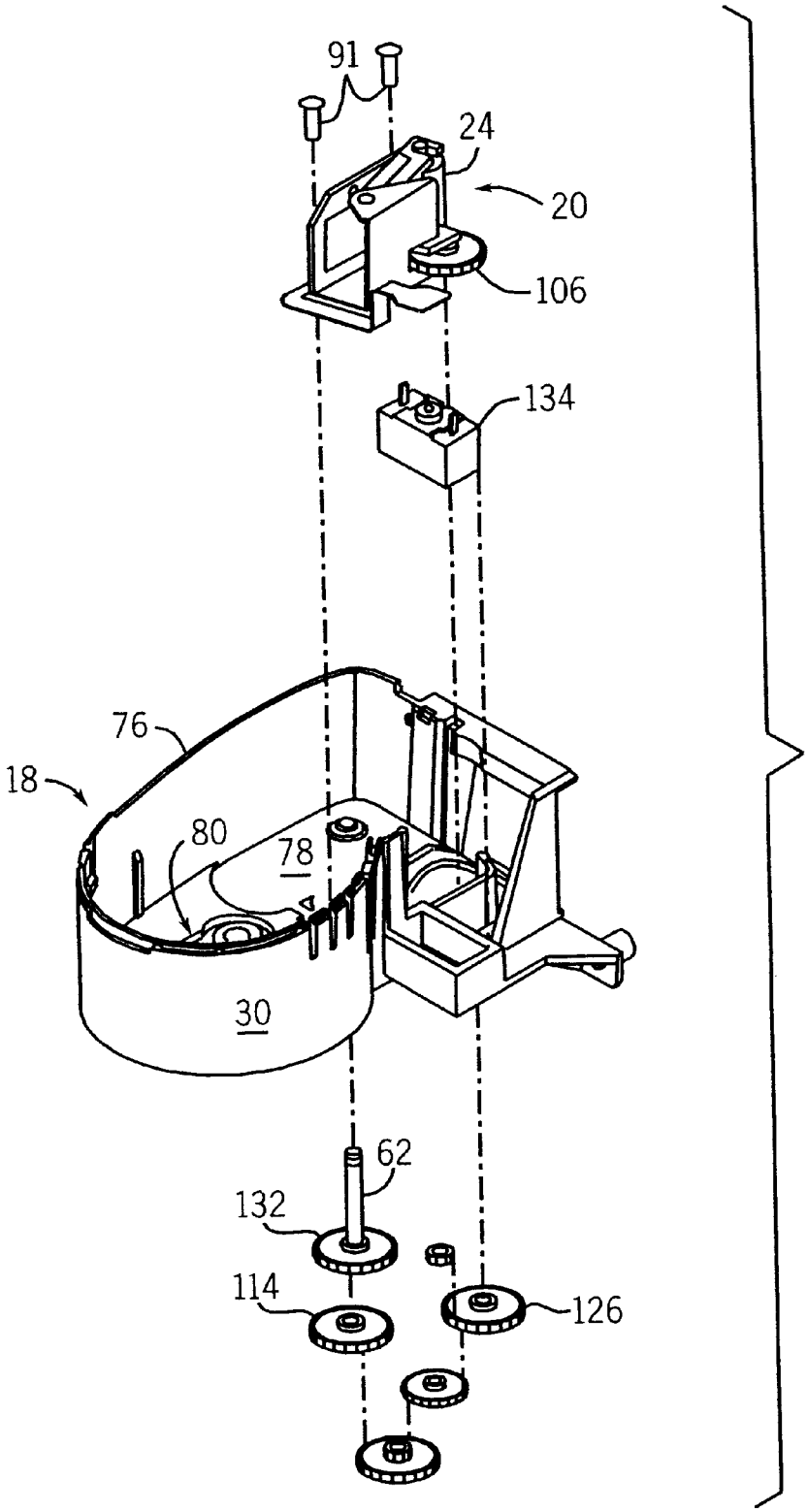
FIG. 10 is an exploded perspective view of the cartridge receptacle and cutter mechanism of FIG. 3.

Referring particularly to FIGS. 1–3, a thermal printing machine 10 which employs the preferred embodiment of the present invention includes a molded plastic housing 2 that supports a keyboard 4 on its front surface and a display 6 positioned above the keyboard 4. An opening 8 formed in the housing 2 above the display 6 receives a cartridge 12 containing labeling media 14 and an ink ribbon 16 (shown in FIG. 6). The cartridge 12 is inserted through the opening 8 into a cartridge receptacle 18 housed in the printer housing 2, and the labeling media 14 and ink ribbon 16 from the cartridge are threaded through a printer mechanism assembly 20 including a print head 22 and roller platen 24 for printing indicia on labels forming part of the labeling media 14. The printed labels pass through a cutter mechanism 26 which cuts the labeling media to separate the printed labels from unprinted labels.

The labeling media 14 is known in the art, and generally comprises a carrier web which supports a series of adhesive labels. The size, width, color, and type of web material varies depending upon the particular print application. The labeling media is dispensed from the cartridge 12, and urged along a web path as it is consumed by the printer 10.

Referring to FIGS. 3–7, the cartridge 12 includes a cartridge housing 28 having a top wall 30 and a bottom wall 32 joined by periphery walls 34, 36, 38, 40. The periphery walls 34, 36, 38, 40 define a semi circular labeling media container 42 and a rectangular ink ribbon container 44 joined to the labeling media container 42. The top wall 30 extends past the periphery walls 34, 38, and defines a printing area 46 outside of the housing periphery walls 34, 38 at the junction of the labeling media container 42 and ink ribbon container 44. Labeling media 14 and ink ribbon 16 from inside the cartridge 28 housing pass through the printing area 46 for engagement with the roller platen 24 and print head 22. A shelf 48 formed along one edge of the top wall 30 is flush with the printer opening 8 to allow engagement of the shelf 48 with a lever 50 which locks the cartridge 12 in the receptacle 18.

The labeling media container 42 receives the labeling media 14 in the form of a roll. An exit slot 52 formed in the periphery wall 34 defining the labeling media container 42 opens into the printing area 46, and provides an exit for the labeling media 14 and ink ribbon 16 to pass out of the cartridge housing 28 and into the printing area 46. A projection 54 extending adjacent to the exit slot 52 guides the labeling media 14 and ink ribbon 16 as they exit the cartridge 12 through the exit slot 52.

The ink ribbon container 44 extends tangentially from the semicircular labeling media container 42, and has a proximal end 56 which opens into the labeling media container 42 and an opposing, closed, distal end 58 joined by the exterior periphery wall 36 which is a tangential extension of the labeling media container periphery wall 34. The interior ink ribbon periphery wall 38 extending between the proximal and distal ends 56, 58 is spaced from the ink ribbon exterior periphery wall 36, and defines a boundary of the printing area 46. Ink ribbon 16 which has passed through the printing area 46 reenters the ink ribbon container 44 through an entrance slot 60 formed at the junction of the interior ink ribbon periphery wall 38 and the ink ribbon container periphery end wall 40.

An ink ribbon supply spool (not shown) is supported between the top and bottom walls 30, 32 of the cartridge housing 28, and has a roll of ink ribbon 16 wound thereon. The ink ribbon 16 is unwound from the supply spool, and passes out of the cartridge 12 with the labeling media 14 through the exit slot 52. The ink ribbon 16 reenters the cartridge 12 through the entrance slot 60, and is wound onto an ink ribbon take up spool (not shown).

The take up spool is supported between the cartridge housing top and bottom walls 30, 32, and is rotatably driven by an ink ribbon drive shaft 62 which extends through an opening 64 formed in the cartridge bottom wall 32. The shaft 62 engages the take up spool to rotatably drive the spool and wind the ink ribbon 16 thereon.

A labeling media guide 66 is formed at the ink ribbon container distal end 58, and extends perpendicular to the interior ink ribbon periphery wall 38. A guiding slot 67 formed in the guide 66 directs the labeling media 14 which is passed through the printing area 46 toward the cutter mechanism 26.

Referring back to FIGS. 1–3, the cartridge 12 is received in the cartridge receptacle 18 housed in the printer housing 2. The printer housing 2 is, preferably, formed from two halves 68, 70, and houses printer components, such as the cartridge receptacle 18, the keyboard 4, display 6, the cutter mechanism 26, a printed circuit board 72 having printer circuitry, and the like. The opening 8 formed in the housing top half 68 provides access to the cartridge receptacle 18 for insertion of the cartridge 12 into the receptacle 18. A slot 74 formed in the housing 2 adjacent the cutter mechanism 26 provides an exit for labeling media 14 (FIG. 6) which has passed through the cutter mechanism 26.

Referring to FIGS. 6–12, the cartridge receptacle has a sidewall 76 generally shaped to conform with the cartridge periphery walls 34, 36, 38, 40, and a floor 78 which supports the cartridge 12 therein. An eject mechanism 80 is formed as an integral part of the receptacle floor 78, and includes a cantilevered arm 82 with a button 84 extending perpendicular to the arm 82 from the arm distal end 86. The button 84 extends away from the receptacle floor 78 through the printer housing 2 (FIG. 2) for engagement by a user. The user urges the button 84 toward the receptacle 18 to engage the arm 82 with the cartridge 12 and push the cartridge 12 out of the receptacle 18.

The printer mechanism assembly 20 is fixed to the printer receptacle 18, and includes the stationary print head 22 and pivotable platen roller 24 mounted on a U-shaped frame 88. The U-shaped frame 88 includes two upwardly extending legs 90, 92 joined by a base 94 (FIG. 2). One leg 90 has an inwardly facing surface 96 for mounting the print head 22 thereon. The opposing leg 92 has a distal end 98 with a tab 100 extending inwardly toward the one leg 90. Preferably, the frame 88 is fixed to the receptacle 18 with screws 91. However, any method known in the art for fixing a frame to another object, such as rivets, bonding, and the like, can be used without departing from the scope of the present invention.

The fixed thermal print head 22 is mounted to the inwardly facing surface 96 of the leg, and extends into the cartridge printing area 46 when the cartridge 12 is received in the receptacle 18. The print head 22 cooperates with the ink ribbon 16 and the labeling media 14 such that the print head 22 can print characters or symbols on the labeling media. This is described in greater detail in U.S. Pat. No. 5,078,523 which is incorporated herein by reference. The labeling media 14 and ink ribbon 16 passing through the printing area 46 are advanced past the print head 22 by the platen roller 24 which maintains the ribbon 16 and labeling media 14 in close cooperation with the print head 22.

The platen roller 24 is mounted on a roller shaft 102 which is rotatably fixed to an end 108 of a pivot linkage 104. One end of the drive shaft 62 extends through the receptacle floor 78. A drive gear 106 is fixed to the one end of the shaft 102, and is coaxial with the platen roller 24. The drive gear 106 engages a stationary gear 114 which is rotatably mounted to the underside of the receptacle floor 78. The stationary gear 114 forms part of a gear assembly 116, and meshes with the drive gear 106 to rotatably drive the platen roller 24.

The pivot linkage 104 has an opposing end 110 pivotally fixed to a pin 112 supported between the frame tab 100 and base 94 (FIG. 2). The pivot linkage pivots 104 about the pin 112 to move the platen roller 24 between a printing position (shown in FIG. 12) and a nonprinting position (shown in FIG. 11) and to engage and disengage the drive gear 106 from the stationary gear 114. A cam follower 111 extending from the pivot linkage 104 between the linkage ends 108, 110 engages a cam 118 to pivot the linkage 104 about the pin 112. Although fixing the pivot linkage 104 to the pin 112 supported between the frame tab 100 and base 94 (FIG. 2) is disclosed, other methods for movably mounting the platen roller relative to the print head, such as slidably mounting the roller shaft in a slot formed in the housing and the like, can be used without departing from the scope of the present invention.

As shown in FIG. 12, when the pivot linkage 104 pivots to move the platen roller 24 to the printing position, the drive gear 106 engages a rotatably driven stationary gear 114 to rotatably drive the platen roller 24, and the platen roller 24 extends into the receptacle 18 (FIG. 7) and urges the labeling media 14 and ink 16 ribbon against the print head 22. In the nonprinting position shown in FIG. 11, the drive gear 106 is disengaged from the stationary gear 114, and the platen roller 24 is spaced from the print head 22 to allow insertion of the labeling media 14 and ink ribbon 16 therebetween.

Referring to FIGS. 2–4, 8–12, the cam 118 engages the pivot linkage 104 to move the platen roller 24 from the nonprinting position to the printing position and to engage and disengage the drive gear 106 with the stationary gear 114. A spring 121 wrapped around one end of the pin 112 biases the linkage 104 against the cam 118 to bias the pivot linkage 104 away from the platen roller printing position. The cam 118 is fixed to a cam shaft 120 which is rotated about a cam shaft axis 113 by the lever 50 fixed to an end of the cam shaft 120 extending through the printer housing 2.

Figure 13:
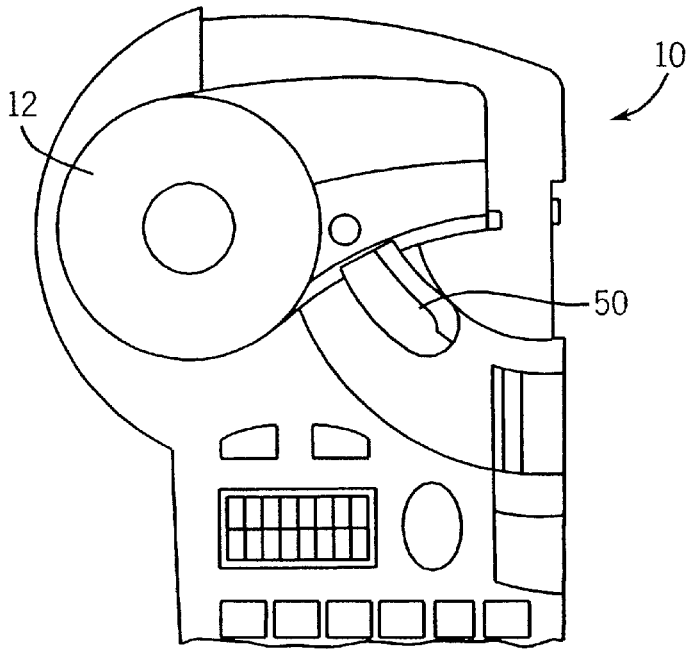
FIG. 13 is a front view of the printer of FIG. 1 with the lever in the lock position.

The elongated lever 50 has one end 124 fixed to the cam shaft 120, and is pivotable about the cam shaft axis 113 (shown in FIGS. 11 and 12) between a lock position (shown in FIG. 13) and an unlock position (shown in FIG. 1). Pivoting the lever 50 about the cam shaft axis 113 between the lock and unlock positions, rotates the camshaft 120 to engage and disengage the cam 118 from the pivot linkage 104. Advantageously, in the lock position, the lever opposed end 127 extends over the receptacle 18, and engages the top wall shelf 48 of the cartridge 12 to lock the cartridge 12 in the receptacle 18. In the unlock position, the lever 50 is disengaged from the cartridge 12, and allows the cartridge 12 into or out of the receptacle. Preferably, the lever 50 includes a rib 122 extending along a lever edge to provide an engagement surface for a user to easily engage the lever 50 to pivot it about the cam shaft axis 113.

Referring back to FIGS. 7 and 8, the gear assembly 116 includes a plurality of intermeshed gears 114, 126, 128, 130, 132 rotatably mounted to the underside of the receptacle floor 78. The gear assembly 116 is rotatably driven by a motor 134 fixed to the receptacle 18. The motor 134 includes a shaft 136 which extends through the receptacle floor 78, and has a pinion 138 fixed to the shaft 136 which meshes with the gear assembly 116. The printer circuitry energizes the motor 134 to rotatably drive the shaft 136, and thus the stationary gear 114.

One of the plurality of intermeshed gears 132 is fixed to and coaxial with the ink ribbon drive shaft 62 which extends through the receptacle floor 78 to rotatably drive the ink ribbon take up spool. Advantageously, the gear assembly 116 simultaneously drives the platen roller 24 and ink ribbon drive shaft 62 to synchronize the operation of the platen roller 24 and ink ribbon take up spool to smoothly urge the ink ribbon 16 (FIG. 6) and labeling media 14 (FIG. 6) along the web path.

Referring to FIGS. 3–12, in use, the lever 50 is positioned in the unlock position which moves the platen roller 24 and drive gear 106 to the nonprinting position to retract the platen roller 24 away from the print head 22 and disengage the drive gear 106 from the stationary gear 114. The cartridge 12 is then inserted into the cartridge receptacle 18, such that the labeling media 14 and ink ribbon 16 in the cartridge printing area 46 slips between the print head 22 and platen roller 24, and the ink ribbon drive shaft 62 engages the take up spool.

Once the cartridge 12 is inserted into the receptacle 18, the lever 50 is pivoted about the camshaft axis 113 to extend over the receptacle 18 and engage the cartridge top wall shelf 48, and thus lock the cartridge 12 in the receptacle 18. Pivoting the lever 50 rotates the camshaft 120 and engages the cam 118 with the pivot linkage cam follower 111 to move the platen roller 24 and drive gear 106 into the printing position to sandwich the labeling media 14 and ink ribbon 16 between the print head 22 and platen roller 24 and engage the drive gear 106 with the gear assembly 116.

Once the cartridge 12 is locked in place, the platen roller 24 is in the printing position, and the drive gear 106 is engaged with the stationary gear 114, the printing machine 10 (FIG. 1) is ready to produce printed labels. When printing on the labels, the platen roller 24 and a take up spool advance the labeling media 14 and ribbon 16 through the printing area 46 past the print head 22. When a desired character is input by an operator or other means, the electronics of the machine 10 energizes pixels on the print head 22 as the labeling media 14 and ribbon 16 advance past the print head 22. The head pixels are variously energized to imprint the character on the labeling media 14. This is described in greater detail in U.S. Pat. No. 5,078,523 which has been incorporated herein by reference.

The cartridge 12 is removed by pivoting the lever 50 to the unlock position which disengages the lever 50 from the cartridge 12 and moves the platen roller 24 to the nonprinting position and disengages the drive gear 106 from the stationary gear 114. The cartridge 12 is ejected from the receptacle 18 by urging the eject mechanism button 84 towards the cartridge 12 to force the cartridge 12 out of the receptacle 18.

While there has been shown and described what is at present considered the preferred embodiment of the invention, it will be obvious to those skilled in the art that various changes and modifications can be made therein without departing from the scope of the invention defined by the appended claims.

We claim:

1. A printer comprising:

a receptacle for receiving a printer cartridge therein;

a print head disposed in said receptacle;

a platen roller rotatable about a roller axis, and one of said print head and platen roller being movable relative to the other of said print head and platen roller between a printing position in which said platen roller is in close proximity to said print head for urging labeling media and ink ribbon toward said print head and a nonprinting position in which said roller platen is spaced a distance from said print head to allow the labeling media and ink ribbon to be slipped therebetween;

a platen roller gear coaxial with said platen roller;

a drive gear engaging said platen roller gear when said one of said print head and platen roller is in the printing position, and disengaged from said platen roller gear when said one of said print head and platen roller is in the nonprinting position; and a lever linked to said platen roller, and being movable between a lock position and an unlock position, wherein movement of said lever from said unlock position to said lock position moves said platen roller from the nonprinting position to the printing position and extends said lever over said receptacle to lock a printer cartridge received therein.

2. The printer as in claim 1, in which said platen roller is rotatably fixed to a pivot linkage, said pivot linkage being pivotally fixed relative to said print head to move said platen roller between said printing position and said nonprinting position.

3. The printer as in claim 2, in which a cam acts on said pivot linkage to pivot said pivot linkage and move said platen roller between said printing position and said nonprinting position.

4. The printer as in claim 3, in which said pivot linkage includes a cam follower, and said cam acts on said cam follower.

5. The printer as in claim 3, in which said cam is fixed to a camshaft which is rotated when said lever is moved between said lock position and said unlock position.

6. The printer as in claim 5, in which said lever is fixed to said camshaft.

7. The printer as in claim 1, in which said lever includes a rib having an engagement surface for engagement by a user to move said lever between said lock position and said unlock position.

8. The printer as in claim 1, in which said print head is fixed relative to a floor of said receptacle.

9. A printer comprising:

a cartridge receptacle for receiving a printer cartridge, said receptacle having sidewalls joined by a floor;

a print head disposed in said receptacle, and fixed relative to said receptacle floor;

a pivot linkage movably fixed relative to said print head;

a platen roller fixed to said pivot linkage, and being rotatable about a roller axis, wherein pivotal movement of said pivot linkage moves said platen roller between a printing position in close proximity to said print head for urging labeling media and ink ribbon toward said print head and a nonprinting position in which said roller platen is spaced a distance from said print head to allow the labeling media and ink ribbon to be slipped therebetween;

a platen roller gear coaxial with said platen roller;

a drive gear engaging said platen roller gear when said platen roller is in the printing position, and disengaged from said platen roller gear when said platen roller is in the nonprinting position;

a cam acting on said pivot linkage to pivot said pivot linkage and move said platen roller between said printing position and said nonprinting position;

a camshaft supporting said cam, and rotatably mounted relative to said pivot linkage, said camshaft having an end; and a lever fixed to said camshaft end, and movable between a lock position and an unlock position, wherein movement of said lever from said unlock position to said lock position rotates said camshaft to engage said cam with said pivot linkage to move said platen roller from the nonprinting position to the printing position and extends said lever over said receptacle to lock a printer cartridge received therein.

10. The printer as in claim 9, in which said cam is formed as an integral part of said camshaft.

11. The printer as in claim 9, in which said lever includes a rib having an engagement surface for engagement by a user to move said lever between said lock position and said unlock position.

12. The printer as in claim 9, in which said pivot linkage includes a cam follower, and said cam acts on said cam follower.

13. A method of loading a cartridge into a printer having a cartridge receptacle for receiving the cartridge, and having a roller platen and print head, said method comprising:

inserting a cartridge containing labeling media and ink ribbon therein into the receptacle, wherein a portion of the labeling media and ink ribbon are disposed along a path disposed outside of the cartridge;

slipping the labeling media and ink ribbon disposed outside of the cartridge between the print head and the roller platen; and moving at least a portion of a lever over the cartridge to lock the cartridge in the receptacle, wherein moving the lever moves one of the print head and roller platen relative to the other of the print head and roller platen to sandwich the labeling media and ink ribbon between the platen roller and print head, and moving the lever engages a drive gear coaxial with the platen roller with a stationary gear which rotatably drives the drive gear to rotate said platen roller.

14. The method as in claim 13, in which moving at least a portion of a lever over said cartridge to lock said cartridge in said receptacle includes engaging a cam with a pivot linkage having the roller platen fixed thereto, said cam moves the pivot linkage to move the platen roller from a nonprinting position to a printing position, in which in the printing position the labeling media and ink ribbon are sandwiched between the platen roller and print head.

15. The method as in claim 14, wherein moving said lever rotates a camshaft having said cam fixed thereto which engages said pivot linkage having said roller platen fixed thereto, said cam pivotally moves said pivot linkage to move said platen roller from the nonprinting position to the printing position, and pivoting said lever engages said drive gear with the stationary gear.

* * * * *

UNITED STATES PATENT AND TRADEMARK OFFICE

CERTIFICATE OF CORRECTION

PATENT NO. : 6,604,874 B2
DATED : August 12, 2003
INVENTOR(S) : Carriere et al.

It is certified that error appears in the above-identified patent and that said Letters Patent is hereby corrected as shown below:

Column 1,
Line 32, "With et al." should be -- Wirth et al. --

Signed and Sealed this

Twenty-fourth Day of February, 2004

JON W. DUDAS
*Acting Director of the United States Patent and Trademark Office*